US009078480B2

(12) United States Patent
Beschta

(10) Patent No.: US 9,078,480 B2
(45) Date of Patent: Jul. 14, 2015

(54) SYSTEMS, METHODS AND KITS FOR HAIR EXTENSIONS

(76) Inventor: Ted M. Beschta, West Allis, WI (US)

( * ) Notice: Subject to any disclaimer, the term of this patent is extended or adjusted under 35 U.S.C. 154(b) by 290 days.

(21) Appl. No.: 12/430,670

(22) Filed: Apr. 27, 2009

(65) Prior Publication Data

US 2009/0266376 A1 Oct. 29, 2009

Related U.S. Application Data

(60) Provisional application No. 61/048,027, filed on Apr. 25, 2008.

(51) Int. Cl.
*A41G 5/02* (2006.01)
*A45D 44/00* (2006.01)

(52) U.S. Cl.
CPC . *A41G 5/02* (2013.01); *A45D 44/00* (2013.01)

(58) Field of Classification Search
CPC ..... A41G 5/02; A41G 5/008
USPC ..... 132/201, 53, 54, 56; 156/305, 314, 156/331.1, 330.9
See application file for complete search history.

(56) References Cited

U.S. PATENT DOCUMENTS

| | | | | |
|---|---|---|---|---|
| 2,768,109 | A | 10/1956 | Coover, Jr. | |
| 4,847,113 | A | 7/1989 | Wallace | |
| 5,072,745 | A * | 12/1991 | Cheh | 132/201 |
| 5,356,627 | A | 10/1994 | Da Cunha | |
| 5,426,130 | A | 6/1995 | Thurber | |
| 5,470,563 | A * | 11/1995 | Tanaka et al. | 424/448 |
| 5,868,145 | A * | 2/1999 | Spann | 132/201 |
| 5,959,009 | A | 9/1999 | Konik | |
| 6,224,622 | B1 | 5/2001 | Kotzev | |
| 6,250,311 | B1 * | 6/2001 | Megna | 132/200 |
| 6,267,951 | B1 * | 7/2001 | Shah et al. | 424/61 |
| 6,849,082 | B2 | 2/2005 | Azevedo | |
| 6,991,782 | B2 | 1/2006 | Kanji | |
| 6,995,227 | B2 * | 2/2006 | Ryan et al. | 526/297 |
| 7,600,519 | B2 | 10/2009 | Dinh | |
| 2004/0149303 | A1 | 8/2004 | Kobayashi | |
| 2004/0168699 | A1 * | 9/2004 | Park | 132/201 |
| 2007/0050207 | A1 * | 3/2007 | Merszei | 705/2 |
| 2007/0227550 | A1 | 10/2007 | Merszei | |
| 2007/0295352 | A1 | 12/2007 | Dinh | |
| 2007/0295353 | A1 | 12/2007 | Dinh | |
| 2008/0196732 | A1 | 8/2008 | Merszei | |
| 2009/0035246 | A1 * | 2/2009 | Do | 424/70.7 |

FOREIGN PATENT DOCUMENTS

| | | |
|---|---|---|
| KR | 10-2005-0095973 | 10/2005 |
| KR | 10-0792229 | 1/2008 |

OTHER PUBLICATIONS

Courtney, P.J., and Verosky, C., "Advances in Cyanoacrylate Technology for Device Assembly" Medical Device and Diagnostic Industry Magazine, Sep. 1999, Column.

Lijoi A., et al., "Subacute left ventricular free wall rupture complicating acute myocardial infarction. Successful surgical repair with a sutureless technique." J. Cardiovascular Surgery, Dec. 1996, 37(6), 627-630.

Tebala, G.D., et al, "The use of cyanoacrylate tissue adhesive in high-risk intestinal anastomoses" Surgery Today, 1995, 25 (12), 1069-72.

Zaki I. et al, "Split skin grafting on severely damaged skin. A technique using absorbable tissue adhesive" J. of Dermatologic Surgery and Oncology, Dec. 1994, 20(12), 827-9.

International Search Report and Written Opinion, PCT/US2009/041818, dated Nov. 27, 2009.

* cited by examiner

*Primary Examiner* — Todd Manahan
*Assistant Examiner* — Brianne Kalach
(74) *Attorney, Agent, or Firm* — Casimir Jones S.C.

(57) ABSTRACT

The present invention relates generally to systems, methods, and kits for applying eyelash extensions. In particular, the present invention provides systems, methods, and kits that reduce the amount of time required to apply eyelash extensions.

9 Claims, No Drawings

SYSTEMS, METHODS AND KITS FOR HAIR EXTENSIONS

CROSS-REFERENCE TO RELATED APPLICATIONS

The present application claims priority to pending U.S. Provisional Patent Application Ser. No. 61/048,027, filed Apr. 25, 2008, which is herein incorporated by reference in its entirety.

FIELD OF THE INVENTION

The present invention relates generally to systems, methods, and kits for applying eyelash extensions. In particular, the present invention provides systems, methods, and kits that reduce the amount of time required to apply eyelash extensions.

BACKGROUND

Like hair extensions, eyelash extensions are a cosmetic process whereby synthetic single fiber polyester thread like materials are applied to create a fuller, longer look. Once a product accessible only to a limited consumer, eyelash extensions have become more popular and affordable. In Asia, the United States and Australia, for example, the process has become so popular that salons are booked as much as six weeks in advance. Aiming for an authentic, natural feel, they come in various lengths, colors and thicknesses, and can be worn during sleep, showering and swimming. However, excessive exposure to oil can weaken adhesive bond. Eyelash extensions differ greatly from "fake" or "false" eyelashes in that they are applied one extension to one lash, and can last for two to six weeks. They look natural and not like strip lashes.

The eyelash extension application procedure, however, takes an extended amount of time. As such, improvements in the eyelash extension procedure are needed.

SUMMARY

The present invention relates generally to systems, methods, and kits for applying eyelash extensions. In particular, the present invention provides systems, methods, and kits that reduce the amount of time required to apply eyelash extensions.

Experiments conducted during the course of developing embodiments for the present invention determined that application of a sealing agent (e.g., toluidine or a functional equivalent thereof) to an eyelash extension bonded to a natural eyelash through use of a bonding agent (e.g., cyanoacrylate or a functional equivalent thereof) greatly reduces the time required to secure the eyelash extension with the natural eyelash (e.g., less than 2 hours for 30-80 eyelash extensions) (e.g., less than 1 hour for 30-80 eyelash extensions) (e.g., less than 45 minutes for 30-80 eyelash extensions) (e.g., less than 30 minutes for 30-80 eyelash extensions) (e.g., less than 30 seconds per eyelash extension, less than 25 seconds per eyelash extension, less than 15 seconds per eyelash extension, less than 10 seconds per eyelash extension, less than 5 seconds per eyelash extension, approximately 2-3 seconds per eyelash extension, approximately 1 second, approximately less than 1 second). Moreover, experiments conducted during the course of developing embodiments for the present invention determined that during a procedure involving securing of eyelash extensions to natural eyelashes, the bonding agent (e.g., cyanoacrylate) may remain uncured despite application of a sealing agent (e.g., through inadvertent human application error). It was determined that subsequent application of a coating agent to the eyelash extension resulted in curing of uncured bonding agent (e.g., thereby reducing any risk for exposure of the bonding agent to the optical region). As such, the present invention provides a significant improvement over existing methods for securing eyelash extensions to natural eyelashes through reducing the amount of time between application and curing of the bonding agent (e.g., cyanoacrylate).

Accordingly, in certain embodiments, the present invention provides systems and methods for securing an eyelash extension with a natural eyelash, comprising providing a natural eyelash, an eyelash extension, a bonding agent, and a sealing agent; applying the bonding agent to the eyelash extension; attaching the eyelash extension with the natural eyelash; and applying the sealing agent to the eyelash extension attached with the natural eyelash. In some embodiments, the systems and methods further involve application of a coating agent so as to cure uncured bonding.

The systems and methods are not limited to a particular bonding agent. In some embodiments, the bonding agent is cyanoacrylate (or a functional equivalent) or a UV light cured gel product. The systems and methods are not limited to using a particular amount of bonding agent (e.g., cyanoacrylate) per application (e.g., per eyelash extension). Experiments conducted during the course of developing embodiments for the present invention determined that cyanoacrylate is an effective bonding agent for securing an eyelash extension with a natural eyelash. In addition, it was determined that approximately 2 drops (e.g., ½ drop, 0.75 drops, 1 drop, 1.25 drops, 1.5 drops, 2 drops, 3 drops, 4 drops, 5 drops) of cyanoarylate was an effective amount of bonding agent for securing a set of eyelash extensions with respective natural eyelashes (e.g., 30-80 eyelash extensions). In some embodiments, the drops measure approximately ⅛ inch by ⅛ inch (e.g., 1/16 by 1/16 inch, ⅛ inch by ⅛ inch, ¼ by ¼ inch, ½ inch by ½ inch). The systems and methods are not limited to a particular type of cyanoacrylate. In some embodiments, the bonding agent is a methyl cyanoacrylate, or an ethyl cyanoacrylate.

The methods are not limited to a particular sealing agent. In some embodiments, the sealing agent is any type of cyanoacrylate accelerator and/or activator. In some embodiments, the sealing agent is toluidine (or a functional equivalent), ethyl acetate (or a functional equivalent), butyl acetate (or a functional equivalent), isopropyl alcohol (or a functional equivalent), acetone (or a functional equivalent), methyl ethyl ketone (or a functional equivalent), alkyl toluidines (or a functional equivalent), ethanol (or a functional equivalent), isopropanol (or a functional equivalent), heptanes (or a functional equivalent), heptanol (or a functional equivalent), etc. In some embodiments, the sealing agent is designed to make the bonding agent dry in less than 10 seconds (e.g., 10 seconds, 9 seconds, 8 seconds, 5 seconds, 4 seconds, 2-3 seconds, 1 second, less than). The methods are not limited to using a particular amount of sealing agent (e.g., toluidine) per application (e.g., per eyelash extension). Experiments conducted during the course of developing embodiments for the present invention determined that approximately 1.5 ml (e.g., 0.5 ml, 0.75 ml, 1 ml, 1.25 ml, 1.5 ml, 1.75 ml, 2 ml, 2.25 ml, 2.5 ml, 2.75 ml, 3 ml, 3.25 ml, 3.5 ml) of sealing agent (e.g., toluidine) was an effective amount for inducing curing of the bonding agent (e.g., cyanoacrylate) within approximately 2 seconds for a set of eyelash extensions (e.g., 30-80 eyelash extensions) with respective natural eyelashes.

The methods are not limited to a particular type or kind of coating agent. In some embodiments, the coating agent is a composition comprising a water resistant agent. In some embodiments, the coating agent is a composition comprising, for example, a volatile solvent (e.g., isododecane, an isomer of dodecane, or a functional equivalent thereof), animal-derived waxes (e.g., beeswax), vegetal based waxes (e.g., carnauba wax, rice bran wax, candelila wax), mineral origin wax (e.g., ozokerite, paraffin), pigments (e.g., iron oxide, ultramarine), and filmifying polymers. In some embodiments, the coating agent comprises a composition as described in U.S. Pat. Nos. 6,991,782, 5,959,009; 5,356,627; each herein incorporated by reference in its entirety.

In some embodiments, the step is repeated for attaching additional eyelash extensions to natural eyelashes.

In some embodiments, a non-porous application (e.g., wand) is used to apply the sealing agent so as to reduce the amount of sealing agent exposed to the region (e.g., to increase safety).

In certain embodiments, the present invention provides a kit for securing an eyelash extension with a natural eyelash, comprising a bonding agent (e.g., cyanoacrylate), a sealing agent (e.g., toluidine), and one or more eyelash extensions. In some embodiments, the kits comprise a cleansing agent (e.g., soap) and/or an application wand (e.g., a non-porous wand). In some embodiments, the kits comprise a coating agent. In some embodiments, the kits comprise instructions for application (e.g., a DVD instructional).

The systems, methods and kits of the present invention are not solely applicable for application of eyelash extensions to natural eyelashes. Indeed, the systems, methods and kits may be used for applying any kind of hair extensions (e.g., natural and/or synthetic) to any type or region of natural hair (e.g., head hair, facial hair (e.g., eyebrows, beard, mustache, sideburns), androgenic hair (e.g., facial hair, chest hair, underarm hair, abdominal hair, pubic hair), leg hair, back hair, buttocks region, arm hair, foot hair, etc.). In addition, the systems, methods and kits may be used with any kind of subject (e.g., human, dog, cat, mouse, ape, monkey, cow, etc.) (e.g., mammal) having hair. Moreover, it is contemplated that the systems, methods and kits of the present invention may be used as a method for treating hair loss.

DETAILED DESCRIPTION

The procedure to attach eyelash extensions is painless, and can take on average about two hours to apply a full set of eyelash extensions (e.g., roughly 30-80 eyelash extensions per eye). Generally, an "eyelash extensionist" carefully applies each eyelash extension with tweezers and a bonding agent. If properly applied with an adhesive (e.g., cyanoacrylate adhesive), eyelash extensions are designed to bond to one's natural eyelash. Since eyelash extensions shed just like natural lashes, wearers are advised to have them re-applied every 2-4 weeks. The average cycle of a single natural eyelash is 90 days.

The present invention relates generally to systems and methods for applying eyelash extensions. In particular, the present invention provides systems and methods that reduce the amount of time required to apply eyelash extensions.

The present invention is not limited to a particular method for securing eyelash extensions with natural eyelashes (e.g., natural eyelashes on a living human being). In some embodiments, the methods involve exposing an eyelash extension to a bonding agent, attaching the eyelash extension to a natural eyelash, and applying a sealing agent to the eyelash extension attached with the natural eyelash. In some embodiments, the application of the sealing agent results in a reduction of time required for curing of the bonding agent. In some embodiments, the methods further involve applying a coating agent to the eyelash extensions attached to the natural eyelashes (e.g., attached with the bonding agent and sealing agent). In some embodiments, application of the coating agent results in additional curing of the applied bonding agent (e.g., curing of any of the bonding agent inadvertently uncured following application of the sealing agent).

The methods are not limited to a particular type or kind of bonding agent.

In some embodiments, the bonding agent is a UV (ultraviolet light) curable bonding agent. The present application is not limited to a particular type or kind of UV curable bonding agent (see, e.g., U.S. Pat. Nos. 5,426,130, 4,847,113; each herein incorporated by reference in its entirety). In some embodiments, the UV curable bonding agent is any type of adhesive that can be cured through exposure to ultraviolet light. In some embodiments, the UV curable bonding agent is a UV 3321 bonding agent offered by Loctite Corporation of Rocky Hill, Conn. In some embodiments, the UV curable bonding agent is an acrylic agent (e.g., methylacrylate ester) or a functional equivalent thereof. In some embodiments wherein the bonding agent is a UV curable bonding agent, the bonding agent is cured through exposure to UV light.

In some embodiments, the bonding agent is a composition comprising cyanoacrylate or a functional equivalent thereof (see, e.g., Lijoi, A., et al., J. Cardiovascular Surgery, December 1996, 37(6), 627-630; Tebala, G. D., et al, Surgery Today, 1995, 25 (12), 1069-72; Zaki, I. et al, J. of Dermatologic Surgery and Oncology, 1994 December, 20(12), 827-9; each herein incorporated by reference in its entirety). Generally, cyanoacrylates are solvent-free, one-part adhesives that cure rapidly when pressed into a thin film between two surfaces (see, e.g., Courtney, P. J., and Verosky, C., Medical Device and Diagnostic Industry Magazine, September 1999, Column; herein incorporated by reference in its entirety). Their ease of use and availability in USP Class VI—qualified formulations have made them attractive to manufacturers of a wide variety of medical devices. Cyanoacrylates are one-part, room-temperature-curable adhesives that are available in a wide range of viscosities. When confined in a thin film between two surfaces or sprayed with a chemical activator, cyanoacrylates cure rapidly to form rigid thermoplastics with excellent adhesion. Cyanoacrylates typically fixture within 1 minute and achieve full bond strength in 24 hours. Cyanoacrylate adhesives are cyanoacrylate esters, of which methyl and ethyl cyanoacrylates are commonly used in adhesive formulation:

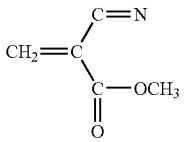

Methyl cyanoacrylate ester

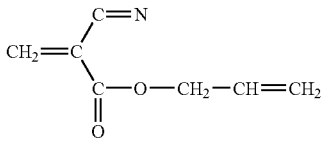

Alkyl cyanoacrylate ester

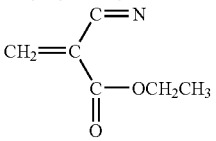

Ethyl cyanoacrylate ester

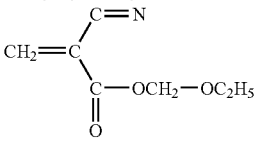

Ethoxymethyl cyanoacrylate ester (see, e.g., Courtney, P. J., and Verosky, C., Medical Device and Diagnostic Industry Magazine, September 1999, Column; herein incorporated by reference in its entirety).

Cyanoacrylates undergo anionic polymerization in the presence of a weak base such as water, and are stabilized through the addition of a weak acid. When the adhesive contacts a surface, trace amounts of water or other species present on the surface neutralize the acidic stabilizer in the adhesive, resulting in the rapid polymerization of the cyanoacrylate:

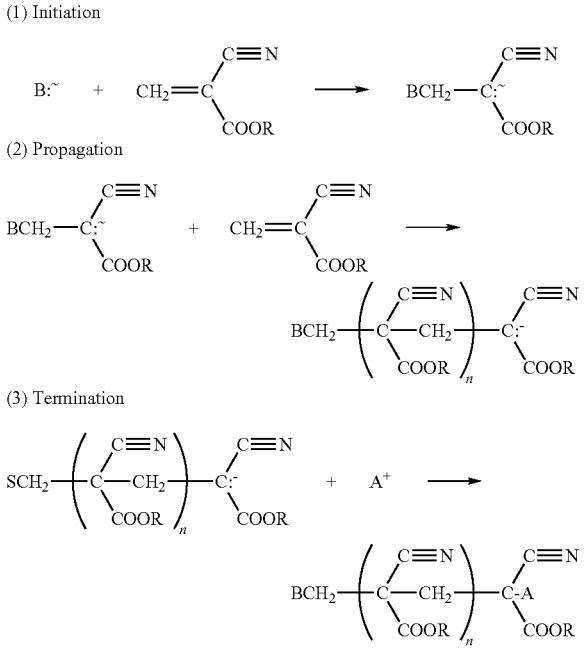

(see, e.g., Courtney, P. J., and Verosky, C., Medical Device and Diagnostic Industry Magazine, September 1999, Column; herein incorporated by reference in its entirety).

The methods are not limited to a particular type of cyanoacrylate. In some embodiments, the cyanoacrylate is, for example, ethyl cyanoacrylate (e.g., ethyl-2-cyanoacrylate), methyl cyanoacrylate (e.g., methyl-2-cyanoacrylate), and/or any of the cyanoacrylate examples recite in, for example, U.S. Pat. Nos. 6,849,082, 6,224,622, 2,768,109; each herein incorporated by reference in its entirety (see, also, e.g., Courtney, P. J., and Verosky, C., Medical Device and Diagnostic Industry Magazine, September 1999, Column; herein incorporated by reference in its entirety).

The methods are not limited to using a particular amount of bonding agent (e.g., cyanoacrylate) per application (e.g., per eyelash extension). Experiments conducted during the course of developing embodiments for the present invention determined that approximately 2 drops (e.g., ½ drop, 0.75 drops, 1 drop, 1.25 drops, 1.5 drops, 2 drops, 3 drops, 4 drops, 5 drops) of cyanoarylate was an effective amount of bonding agent for securing a set of eyelash extensions (e.g., 30-80 eyelash extensions) with respective natural eyelashes. In some embodiments, the effective amount of drops measure approximately ⅛ inch by ⅛ inch (e.g., 1/16 by 1/16 inch, ⅛ inch by ⅛ inch, ¼ by ¼ inch, ½ inch by ½ inch).

There are disadvantages to systems and methods using cyanoacrylate as an agent (e.g., and not using a sealing agent as described herein) (e.g., and not using a cleansing agent as described herein) for securing eyelash extensions to natural eyelashes. Disadvantages of using cyanoacrylate adhesive as a bonding agent, for example, involve its low viscosity (e.g., runniness) while curing, and the length of time required for proper curing (e.g., approximately 2 to 10 minutes per eyelash extension). These disadvantages present a serious risk as accidental exposure of cyanoacrylate to a client's optical region could result in serious injury. In addition, the length of time required to wait for curing presents a temporal burden on the individual receiving the eyelash extensions and the individual applying the eyelash extensions.

Unlike previous descriptions of methods for applying eyelash extensions (see, e.g., U.S. Patent Publication Nos. 20080196732, 20070295353, 20070227550, 20070050207; each herein incorporated by reference in its entirety), the present invention addresses and solves these problems. In particular, the amount of time required for the bonding agent (e.g., cyanoacrylate) to cure is significantly reduced through subsequent application of a sealing agent (e.g., toluidine), and/or subsequent application of a coating agent, thereby reducing potential exposure of the bonding agent to a client's optical region, and thereby reducing the overall time required for application of a complete set of eyelash extensions.

Indeed, experiments conducted during the course of developing embodiments for the present invention determined that application of a sealing agent (e.g., toluidine or a functional equivalent thereof) to an eyelash extension bonded to a natural eyelash through use of a bonding agent (e.g., cyanoacrylate or a functional equivalent thereof) greatly reduces the time required to secure the eyelash extension with the natural eyelash (e.g., less than 2 hours for 30-80 eyelash extensions) (e.g., less than 1 hour for 30-80 eyelash extensions) (e.g., less than 45 minutes for 30-80 eyelash extensions) (e.g., less than 30 minutes for 30-80 eyelash extensions) (e.g., less than 30 seconds per eyelash extension, less than 25 seconds per eyelash extension, less than 15 seconds per eyelash extension, less than 10 seconds per eyelash extension, less than 5 seconds per eyelash extension, approximately 2-3 seconds per eyelash extension, approximately 1 second, approximately less than 1 second). As such, the present invention provides a significant improvement over existing methods for securing eyelash extensions to natural eyelashes through reducing the amount of time between application and curing of the bonding agent (e.g., cyanoacrylate). Accordingly, the present invention provides systems and methods for applying eyelash extensions to natural eyelashes in a reduced amount of time through use of a bonding agent (e.g., cyanoacrylate) and a sealing agent (e.g., toluidine).

In some embodiments, the sealing agent is an accelerant and/or activator designed to cause bonding agents (e.g., cyanoacrylates) to polymerize (e.g., dry, cure) instantly (e.g., approximately 2 seconds). In some embodiments, the sealing agents include an active species (e.g., toluidine) dispersed in a solvent such as acetone or isopropyl alcohol. In some embodiments, the active species is generally a base that is capable of initiating the cure of the cyanoacrylate adhesive. In some embodiments, sealing agents are applied to the substrates being bonded (e.g., eyelash extension/natural eyelash) prior to application of the bonding agent (e.g., cyanoacrylate) in order to minimize fixture time. In some embodiments, sealing agents are applied to the substrates being bonded (e.g., eyelash extension/natural eyelash) subsequent to application of the bonding agent (e.g., cyanoacrylate) in order to permit control of fixture time and to assure proper securing of the eyelash extension prior to curing of the bonding agent. In some embodiments, sealing agents are sprayed over cyanoacrylates to cure fillets of adhesive or unconfined drops.

The methods are not limited to a particular sealing agent. In some embodiments, the sealing agent is toluidine (e.g., o-toluidine, m-toluidine, and p-toluidine) (or a functional equivalent), ethyl acetate (or a functional equivalent), butyl acetate (or a functional equivalent), isopropyl alcohol (or a functional equivalent), acetone (or a functional equivalent), methyl ethyl ketone (or a functional equivalent), alkyl toluidines (or a functional equivalent), ethanol (or a functional equivalent), isopropanol (or a functional equivalent), heptanes (or a functional equivalent), heptanol (or a functional equivalent), etc. Additional examples of sealing agents include, but are not limited to, silacrowns, crown ethers, and calixarenes (see, e.g., U.S. Patent Application Publication No. 2008/0319063; herein incorporated by reference in its entirety). In some embodiments, the sealing agent is designed to make the bonding agent cure in less than 10 seconds (e.g., 10 seconds, 9 seconds, 8 seconds, 5 seconds, 4 seconds, 2-3 seconds, 1 second, less than). In some embodiments, the step is repeated for attaching additional eyelash extensions to natural eyelashes.

The methods are not limited to using a particular amount of sealing agent (e.g., toluidine) per application (e.g., per eyelash extension). Experiments conducted during the course of developing embodiments for the present invention determined that approximately 1.5 ml (e.g., 0.5 ml, 0.75 ml, 1 ml, 1.25 ml, 1.5 ml, 1.75 ml, 2 ml, 2.25 ml, 2.5 ml, 2.75 ml, 3 ml, 3.25 ml, 3.5 ml) of sealing agent (e.g., toluidine) was an effective amount for inducing curing of the bonding agent (e.g., cyanoacrylate) within approximately 2 seconds for a set of eyelash extensions (e.g., 30-80 eyelash extensions) with respective natural eyelashes.

Experiments conducted during the course of developing embodiments for the present invention determined that during a procedure involving securing of eyelash extensions to natural eyelashes, the bonding agent (e.g., cyanoacrylate) may remain uncured despite application of a sealing agent (e.g., through inadvertent human application error). It was determined that subsequent application of a coating agent to the eyelash extension resulted in curing of uncured bonding agent (e.g., thereby reducing any risk for exposure of the bonding agent to the optical region). It was also determined that subsequent application of a coating agent to the eyelash extension rendered the eyelash extensions, for example, waterproof, and removed unwanted residue from the securing procedure.

The methods are not limited to a particular type of coating agent. In some embodiments, the coating agent is a composition comprising a water resistant agent. In some embodiments, the coating agent is a composition comprising, for example, a volatile solvent (e.g., isododecane, an isomer of dodecane, or a functional equivalent thereof), animal-derived waxes (e.g., beeswax), vegetal based waxes (e.g., carnauba wax, rice bran wax, candelila wax), mineral origin wax (e.g., ozokerite, paraffin), pigments (e.g., iron oxide, ultramarine), and filmifying polymers. In some embodiments, the coating agent comprises a composition comprising, for example, a styrene-ethylene-propylene copolymer as gellant, a film-forming agent selected from the group consisting of PVP copolymers dimethicone gum, shellac, polyterpenes, and silicone resins, and a volatile oil (see, e.g., U.S. Pat. No. 5,959,009; herein incorporated by reference in its entirety). In some embodiments, the coating agent comprises a composition comprising dimethicone-silica copolymer, a volatile organic solvent, and at least one cosmetically acceptable wax, in a cosmetic emulsion (see, e.g., U.S. Pat. No. 5,356,627; herein incorporated by reference in its entirety). In some embodiments, the coating agent comprises a composition comprising petroleum distillate, water, dimethicone-silica copolymer, cyclomethicone, iron oxides, carnauba, candelilla wax, isoparaffin, beeswax, lanolin acid, PEG-20 sorbitan beeswax, ozokerite, nylon-12, PVP/eicosene copolymer, phenoxyethanol, parabens, ammonium hydroxide, potassium sorbate and trisodium EDTA (see, e.g., U.S. Pat. No. 5,356,627; herein incorporated by reference in its entirety). In some embodiments, the coating agent comprises a composition as described in U.S. Pat. No. 6,991,782; herein incorporated by reference in its entirety. The methods are not limited to applying a particular amount of coating (see, e.g., U.S. Pat. No. 5,356,627; herein incorporated by reference in its entirety) (see, also, e.g., U.S. Pat. No. 6,991,782; herein incorporated by reference in its entirety).

The methods are not limited to a particular type of eyelash extension (e.g., synthetic hair extension, natural hair extension, mixture of synthetic/natural hair extensions). Indeed, any type or kind of eyelash extension may be utilized (see, e.g., U.S. Patent Application Publication Nos. 20070295353, 20070295352, 0070227550, 20070050207; each herein incorporated by reference in their entireties). In some embodiments, the methods reduce the time required to attach eyelash extensions (e.g., less than 5 seconds per eyelash extension; 2-3 seconds per eyelash extension; 1 second per eyelash extension; less than 1 second per eyelash extension).

In certain embodiments, the present invention provides systems and kits for attaching eyelash extensions. In some embodiments, the systems and kits comprise one or more bonding agents (e.g., cyanoacrylate and/or a functional equivalent thereof), one or more sealing agents (e.g., toluidine and/or a functional equivalent thereof), and/or one or more coating agents. In some embodiments, the systems and kits further comprise a cleansing agent (e.g., soap) for cleaning natural eyelashes. In some embodiments, the systems and kits further comprise one or more eyelash extensions. In some embodiments, the systems and kits comprise an instructional DVD, a microseal application wand (e.g., so as to ensure limited exposure of the sealing agent to the eyelash region), and a receptacle case.

EXAMPLE

This example shows a step by step protocol for attaching eyelash extensions. The present invention is not limited to this method. Indeed, this example is merely an example of the present invention.

1. In your set up for eyelash extensions, place the empty vial provided in "LiquiFan" kit next to you.
2. Place a LiquiFan plastic applicator in the vial
3. Put 2 droppers full of "Sealing Agent" in the vial (replace "Sealing Agent" as needed).
4. Have client clean their natural eyelashes with "Cleanse"
5. Have client lay down. Proceed to cover and protect lower eyelashes with gel pads and adhesive tape.
6. Cover and protect upper eyelid with gel pads.
7. On vinyl matt, lay out the eyelash extension sizes to be used on this client.
8. Put one drop of bonding agent onto a non-porous surface (e.g., tile) and drag eyelash extension through drop of bonding agent.
9. Pick up eyelash extension with tweezers.
10. Isolate natural eyelash with second set of tweezers in opposite hand, keeping all other lashes out of the way.
11. Place eyelash extension with the natural eyelash for which it is to secured.
12. While still isolating eyelash, take plastic applicator out of vial and tap on side of vial, making sure that you do not have an excess of sealilng agent that will drip off. A 'whisper" of sealilng agent will do.
13. Swiftly stroke bonding agent on eyelash as to "spread" out the bonding agent.

14. DO NOT over spread the adhesive. To do so you could risk adhering the plastic applicator to the eyelash. If this should happen you can use your tweezers to hold the eyelash and the applicator and pry them apart in a "twisting" or "rolling" motion.
15. Sometimes "frozen" beads may occur. If you see this happen you should work on your technique of spreading the adhesive. A smooth look is most desired.
16. The use of TheLiquiFan System "Sealing Agent" component INSTANTLY CURES EYELASH EXTENSION ADHESIVE. MAKE SURE YOUR PLACEMENT IS PERFECT PRIOR TO USE
17. Place next eyelash extension and repeat process until desired look is achieved.
18. Check to make sure all extensions are bonded "on their own" and that there are not any eyelash extensions "stuck" together.
19. Carefully remove upper gel pads.
20. Carefully remove layers of tape and gel pad from bottom eyelashes.
21. Have client sit up, keeping eyes closed. Use "Coating Agent" component of The LiquiFan System. Make sure to use a disposable coating applicator and a disposable foam applicator underneath each extension to be coated.
22. Let "Coating Agent" dry on eyelashes for approximately one minute before client opens their eyes; thereby curing any uncured bonding agent.
23. Set up next appointment and enjoy the beauty of your work.

I claim:

1. A method for securing an eyelash extension with a natural eyelash, comprising:

a) providing a natural eyelash, an eyelash extension, a bonding agent, and a sealing agent, wherein said sealing agent comprises one or more selected from the group consisting of toluidine, ethyl acetate, butyl acetate, isopropyl alcohol, acetone, methyl ethyl ketone, alkyl toluidines, ethanol, isopropanol, heptanes, and heptanol, wherein said bonding agent is cyanoacrylate;

b) applying said bonding agent to said eyelash extension;

c) attaching said eyelash extension with said natural eyelash; and d) applying said sealing agent to said eyelash extension attached with said natural eyelash, wherein said applying of said sealing agent occurs before said applied bonding agent has cured, wherein said applying of said sealing agent causes said securing of said eyelash extension with said natural eyelash to occur in one second or less, wherein said securing of said eyelash extension with said natural eyelash occurs at ambient temperature.

2. The method of claim 1, wherein a non-porous applicator is used to apply said sealing agent to said eyelash extension attached with said natural eyelash.

3. The method of claim 2, wherein said non-porous applicator is used to limit exposure of said natural eyelash to said sealing agent.

4. The method of claim 1, further comprising step e) applying a coating agent to said eyelash extension attached with said natural eyelash.

5. The method of claim 4, wherein said application of said coating agent results in curing of said bonding agent.

6. A method for securing an eyelash extension with a natural eyelash, comprising:

a) providing a natural eyelash, an eyelash extension, a bonding agent, and a sealing agent, wherein said bonding agent is cyanoacrylate;

b) applying said bonding agent to said eyelash extension;

c) securing said eyelash extension to said natural eyelash; and d) applying said sealing agent to said eyelash extension attached with said natural eyelash, wherein said applying of said sealing agent occurs before said applied bonding agent has cured, wherein said applying of said sealing agent causes said securing of said eyelash extension with said natural eyelash to occur in one second or less, wherein said securing of said eyelash extension with said natural eyelash occurs at ambient temperature.

7. The method of claim 6, wherein said sealing agent comprises one or more selected from the group consisting of toluidine, ethyl acetate, butyl acetate, isopropyl alcohol, acetone, methyl ethyl ketone, alkyl toluidines, ethanol, isopropanol, heptanes, and heptanol.

8. The method of claim 6, wherein a non-porous applicator is used to apply said sealing agent to said eyelash extension attached with said natural eyelash, wherein said non-porous applicator is used to limit exposure of said natural eyelash to said sealing agent.

9. The method of claim 6, further comprising step e) applying a coating agent to said eyelash extension attached with said natural eyelash.

* * * * *